US007486164B2

(12) United States Patent
Sisley et al.

(10) Patent No.: US 7,486,164 B2
(45) Date of Patent: Feb. 3, 2009

(54) SHOCK-RESISTANT UNDER-VOLTAGE RELEASE

(75) Inventors: James P. Sisley, Baden, PA (US); John J. Henwood, Beaver, PA (US); Robert M. Pomaybo, Beaver, PA (US)

(73) Assignee: Eaton Corporation, Cleveland, OH (US)

( * ) Notice: Subject to any disclaimer, the term of this patent is extended or adjusted under 35 U.S.C. 154(b) by 541 days.

(21) Appl. No.: 11/244,900

(22) Filed: Oct. 6, 2005

(65) Prior Publication Data

US 2007/0080766 A1 Apr. 12, 2007

(51) Int. Cl.
*H01H 3/60* (2006.01)
*H01H 9/00* (2006.01)

(52) U.S. Cl. ..... 335/157; 335/172; 335/176

(58) Field of Classification Search ..... 335/6, 335/21, 38, 46, 104, 105, 157, 172–176
See application file for complete search history.

(56) References Cited

U.S. PATENT DOCUMENTS 4,710,739 A 12/1987 Heyne et al.
4,951,021 A 8/1990 Theisen et al.
5,453,724 A * 9/1995 Seymour et al. ..... 335/172
5,886,605 A * 3/1999 Ulerich et al. ..... 335/172
6,052,047 A 4/2000 Malingowski et al.
6,232,855 B1 5/2001 Malingowski et al.
6,255,924 B1 7/2001 Turner et al.

* cited by examiner

*Primary Examiner*—Ramon M Barrera
(74) *Attorney, Agent, or Firm*—Martin J. Moran

(57) ABSTRACT

A tripping device comprises a coil frame, a coil, a plunger, a spring, and an anti-shock device. The coil is fixedly coupled to the coil frame and has a cylindrical channel extending therethrough. The plunger is reciprocatingly received within the cylindrical channel and the spring is structured to bias the plunger within the cylindrical channel. The anti-shock device includes at least one of a number of anti-shock devices structured to eliminate movement of the coil relative to the coil frame and a number of anti-shock devices structured to eliminate movement of the plunger relative to the cylindrical channel. An under-voltage release mechanism comprises a mounting bracket, a tripping device, and an angled support. The mounting bracket includes a first portion and a second portion. The angled support is fixedly coupled to the mounting bracket between the first and second portions and is structured to prevent flexing of the mounting bracket.

10 Claims, 4 Drawing Sheets

SHOCK-RESISTANT UNDER-VOLTAGE RELEASE

BACKGROUND OF THE INVENTION

1. Field of the Invention

The present invention relates generally to under-voltage release mechanisms and, more particularly, to a shock-resistant under-voltage release mechanism having a shock-resistant tripping device.

2. Background Information

Numerous types of circuit breakers are known and understood in the relevant art. A circuit breaker is typically configured to interrupt a circuit in response to a trip event (e.g., without limitation, an over-current condition; an under-voltage condition). Generally, circuit breakers include a moveable contact that is placed into electrical contact with a stationary contact to complete an electrical circuit. When desired, a tripping mechanism moves the moveable contact away from the stationary contact to interrupt the electrical circuit. Numerous types of tripping mechanisms are known.

In one type of tripping mechanism, for example, one or more trip buttons are provided which, when activated, cause a trip bar to rotate. Rotation of the trip bar causes an interruption mechanism to operate, thereby moving the moveable contact away from the stationary contact. The trip button(s) may be depressed manually, or by a plunger of a trip mechanism, or may be operated by other electrical apparatus as needed for the specific application. One such type of trip mechanism, for example, is an under-voltage release mechanism. An example of an under-voltage release mechanism may be found in U.S. Pat. No. 6,255,924 to Turner et al. which is incorporated herein by reference.

The under-voltage release mechanism employs a tripping device that includes a coil, a magnetically permeable core, and a magnetically permeable and movable plunger, as is generally known and understood in the relevant art. When the circuit breaker is in operation and the movable contact is engaged with the stationary contact, the coil of the tripping device is energized. A magnetic field is generated by the coil which causes the plunger to be biased against a spring. When the circuit voltage is greater than a given preset level, the magnetic field generated by the coil magnetically interacts with the plunger and overcomes the force of the spring such that the plunger is retained in a retracted position (i.e., the plunger is kept away from the trip button). When the circuit voltage drops below the given preset level, however, the magnetic field generated by the coil is insufficient to overcome the force of the spring. Accordingly, the spring biases the plunger into an extended position where the plunger engages the trip button, which, in turn, initiates rotation of the trip bar in order to interrupt the electrical circuit.

While generally effective, such under-voltage release mechanisms are unsuitable for some applications. For instance, circuit breakers employing such under-voltage release mechanisms may be subject to relatively high levels of shock-loading which cause such under-voltage release mechanisms to inadvertently and inappropriately trip the circuit breaker.

Thus, a need exists for an improved shock-resistant under-voltage release mechanism having a shock-resistant tripping device.

SUMMARY OF THE INVENTION

These needs and others are met by the present invention, which is directed to a tripping device comprising a coil frame, a coil, a plunger, a spring, and an anti-shock device. The coil is fixedly coupled to the coil frame and has a cylindrical channel extending therethrough. The plunger is reciprocatingly received within the cylindrical channel and the spring is structured to bias the plunger within the cylindrical channel. The anti-shock device includes at least one of a number of anti-shock devices structured to eliminate movement of the coil relative to the coil frame or a number of anti-shock devices structured to eliminate movement of the plunger relative to the cylindrical channel.

As another aspect of the invention, an under-voltage release mechanism comprises a mounting bracket, a tripping device, and an angled support. The mounting bracket includes a first portion and a second portion, the second portion being normal to the first portion. The tripping device is fixedly coupled to the mounting bracket. The angled support is fixedly coupled to the mounting bracket between the first and second portions. The angled support is structured to prevent flexing of the mounting bracket.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
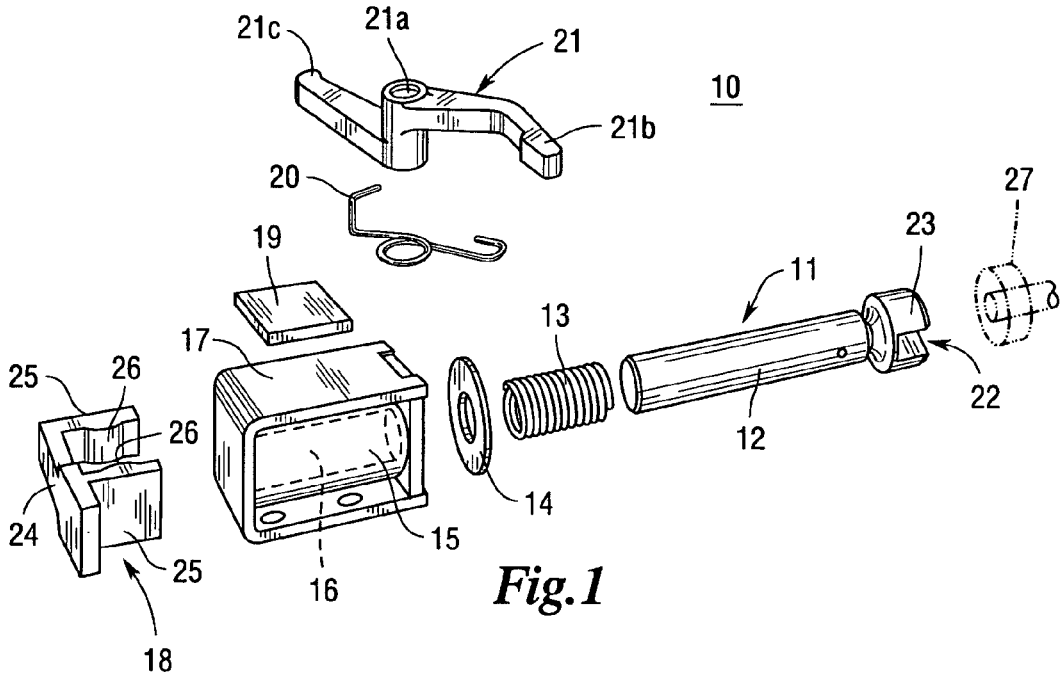
FIG. 1 is an exploded isometric view of a tripping device according to one embodiment of the invention.

Directional phrases used herein, such as, for example, left, right, clockwise, counterclockwise, top, bottom, up, down, and derivatives thereof, relate to the orientation of the elements shown in the drawings and are not limiting upon the claims unless expressly recited therein.

As employed herein, the term "number" shall mean one or more than one.

As employed herein, the statement that two or more parts are "connected" or "coupled" together shall mean that the parts are joined together either directly or joined together through one or more intermediate parts. Further, as employed herein, the statement that two or more parts are "attached" shall mean that the parts are joined together directly.

FIG. 1 shows a tripping device 10 including a coil 15 which is fixedly coupled to a coil frame 17. The coil 15 includes a cylindrical channel 16 (shown in hidden line drawing) which is structured to reciprocatingly receive the first end of a plunger 11. The plunger 11 is substantially cylindrical in shape and includes a cap 23 on a second end thereof. The cap 23 is of slightly larger diameter than the remaining portion of the plunger 11 and has a first surface which is structured to engage one end of a plunger spring 13. A second surface of the cap 23 includes a notch 22 therein which is structured to receive a first end 21*b* of a plunger reset lever 21 as will be described in more detail below. The plunger 11 is structured to be engageable with a circuit breaker trip button 27 (shown in phantom line drawing).

In the current embodiment, the plunger spring 13 is of a generally helical design and is structured to be received by the plunger 11. As discussed above, the first end of the plunger spring 13 engages the first surface of the cap 23. A second end of plunger spring 13 engages a washer 14 which is placed between the plunger spring 13 and the coil frame 17. When compressed, the plunger spring 13 biases the plunger 11 to reciprocatingly move out of the cylindrical channel 16 (i.e., to move the end of the plunger 11 having the cap 23 away from the coil 15).

Figure 4:
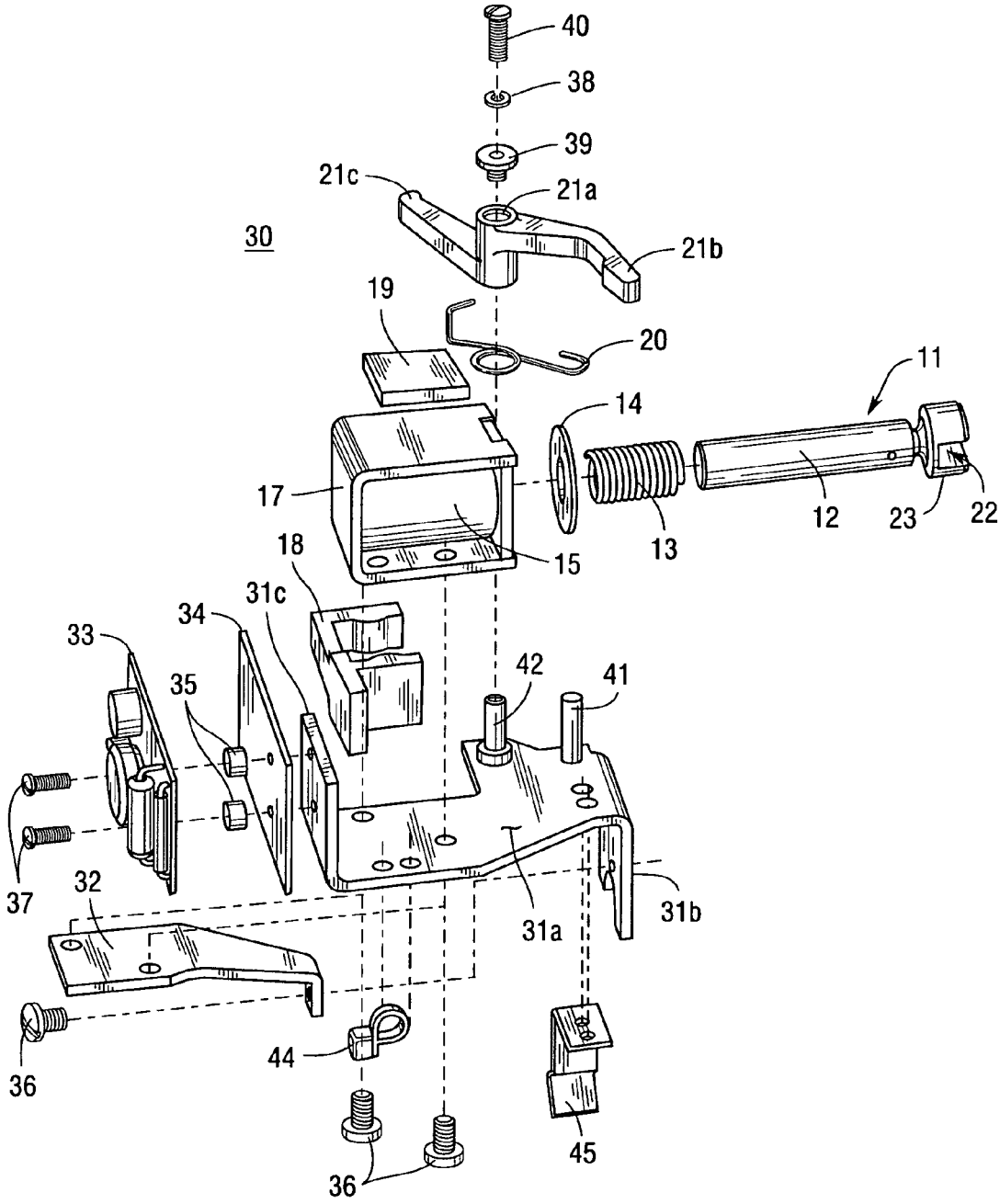
FIG. 4 is an exploded isometric view of the under-voltage release mechanism of FIG. 2.

The plunger reset lever 21 of FIG. 1 includes the first end 21*b* and a second end 21*c* separated by a hub 21*a*. The first end 21*b* is received within notch 22. The plunger reset lever 21 is structured to rotate relative to a pivot 42 (as shown in FIG. 4). When a force imparting a clockwise motion (relative to FIG. 4) is applied to the second end 21*c*, the plunger reset lever 21 causes the plunger 11 to reciprocatingly travel deeper into the cylindrical channel 16 (i.e., to move the end of the plunger 11 having the cap 23 closer to the coil 15), thereby compressing the plunger spring 13. As discussed above, plunger spring 13 biases the plunger 11 to reciprocatingly move out of the cylindrical channel 16 such as to impart a counterclockwise motion on the first end 21*b* and second end 21*c* of the plunger reset lever 21. A stop 41 (as shown in FIG. 4) limits this counterclockwise motion, thus restricting the amount of travel of the plunger 11 relative to the cylindrical channel 16.

The tripping device 10 also includes a number of anti-shock devices structured to eliminate movement of the coil 15 relative to the coil frame 17 and/or a number of anti-shock devices structured to eliminate movement of the plunger 11 relative to the cylindrical channel 16 of the coil 15.

The number of anti-shock devices structured to eliminate movement of the coil 15 relative to the coil frame 17 includes, for example and without limitation, one or both of a clip 18 and a bumper 19.

In the current embodiment, clip 18 includes a base 24 having two sidewalls 25 extending therefrom which generally form a U-shaped structure. Each sidewall 25 includes a protrusion 26 on an inner surface thereof. The clip 18 is structured to couple with the coil frame 17 via a "snap fit". As a result, the need for screws, adhesives, fasteners, or the like is eliminated. The protrusions 26 are in compressive abutting relationship with the coil 15 when the clip 18 is coupled with coil frame 17, thereby preventing side-to-side motion, for example, during a shock-loading event. Although the protrusions 26 are described in the context of a compressive abutting relationship with the coil 15, it should be noted that other relationships may be used while remaining within the scope of the present invention. For example, a relatively small gap may be present between either or both of the protrusions 26 and the coil 15 while remaining within the scope of the present invention.

The bumper 19, in the current embodiment, is coupled to an outside surface of the coil frame 17, for example, using an adhesive. The bumper 19 is a formed of rubber, although other materials (e.g., without limitation, neoprene) may be used. The bumper 19 is structured to absorb impact and dampen vibrations during a shock-loading event.

The number of anti-shock devices structured to eliminate movement of the plunger 11 relative to the cylindrical channel 16 of the coil 15 includes, for example and without limitation, one or both of a sleeve 12 and a bias spring 20. The sleeve 12 is formed from a non-conductive material (e.g., without limitation, brass; plastic) and is structured to reduce the amount of space present between the outer circumference of the plunger 11 and an inner circumference of the cylindrical channel 16.

In FIG. 1, the plunger 11 is shown inserted into the sleeve 12, which extends along substantially the entire length of plunger 11. The sleeve 12 and plunger 11 are then inserted into the cylindrical channel 16. Other arrangements, however, may be used while remaining within the scope of the present invention. For example, the sleeve 12 may be pressed into the cylindrical channel 16 and the plunger 11 inserted into the sleeve 12 without being coupled thereto.

Bias spring 20 is structured to bias the plunger reset lever 21 in a clockwise direction (relative to FIGS. 1 and 4). The force applied by bias spring 20 causes the plunger reset lever 21 to retain the plunger 11 against the plunger spring 13 thereby inhibiting movement of the plunger 11 out of the cylindrical channel 16 during a shock-loading event. However, the force applied by bias spring 20 is not so great as to prevent the plunger 11 from reciprocatingly moving during a trip event (i.e., the force applied by bias spring 20 is overcome by the force applied by plunger spring 13 during a trip event).

Figure 2:
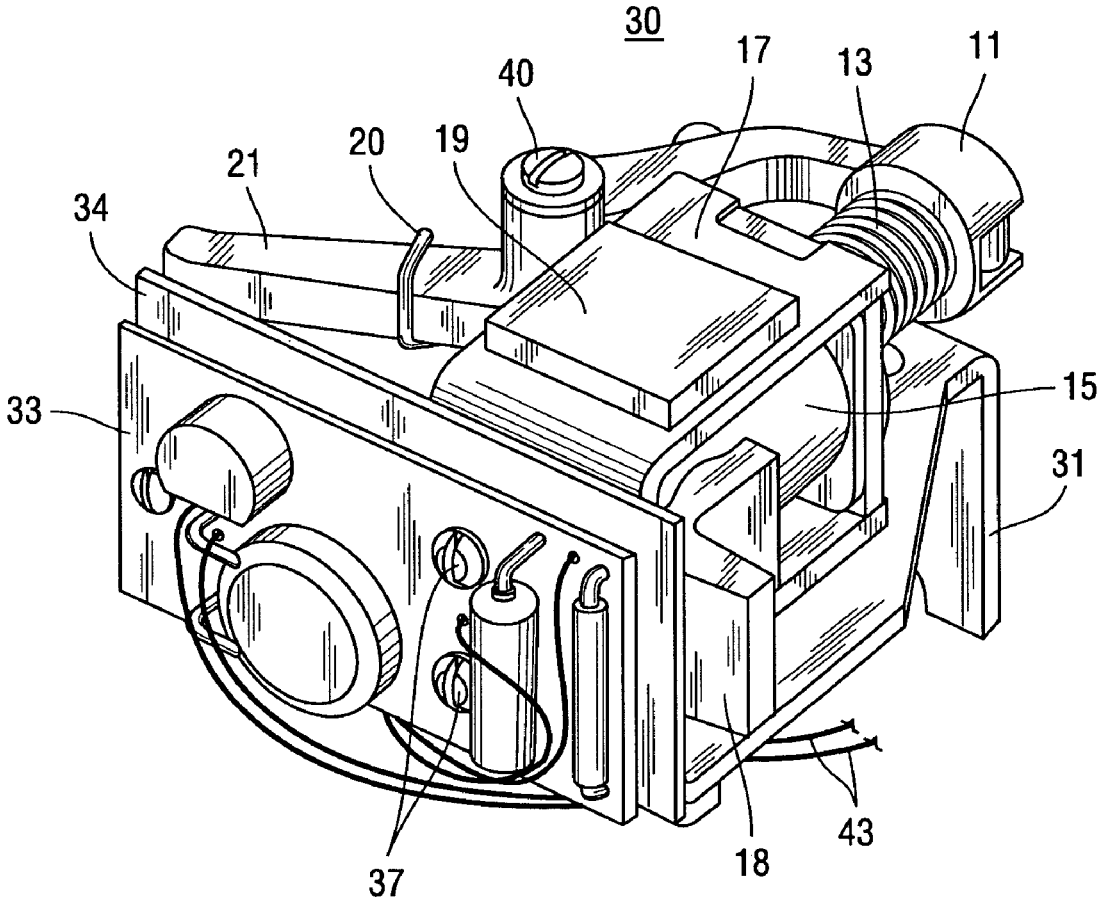
FIG. 2 is an isometric view of an under-voltage release mechanism incorporating the tripping device of FIG. 1 according to another embodiment of the invention.
Figure 3:
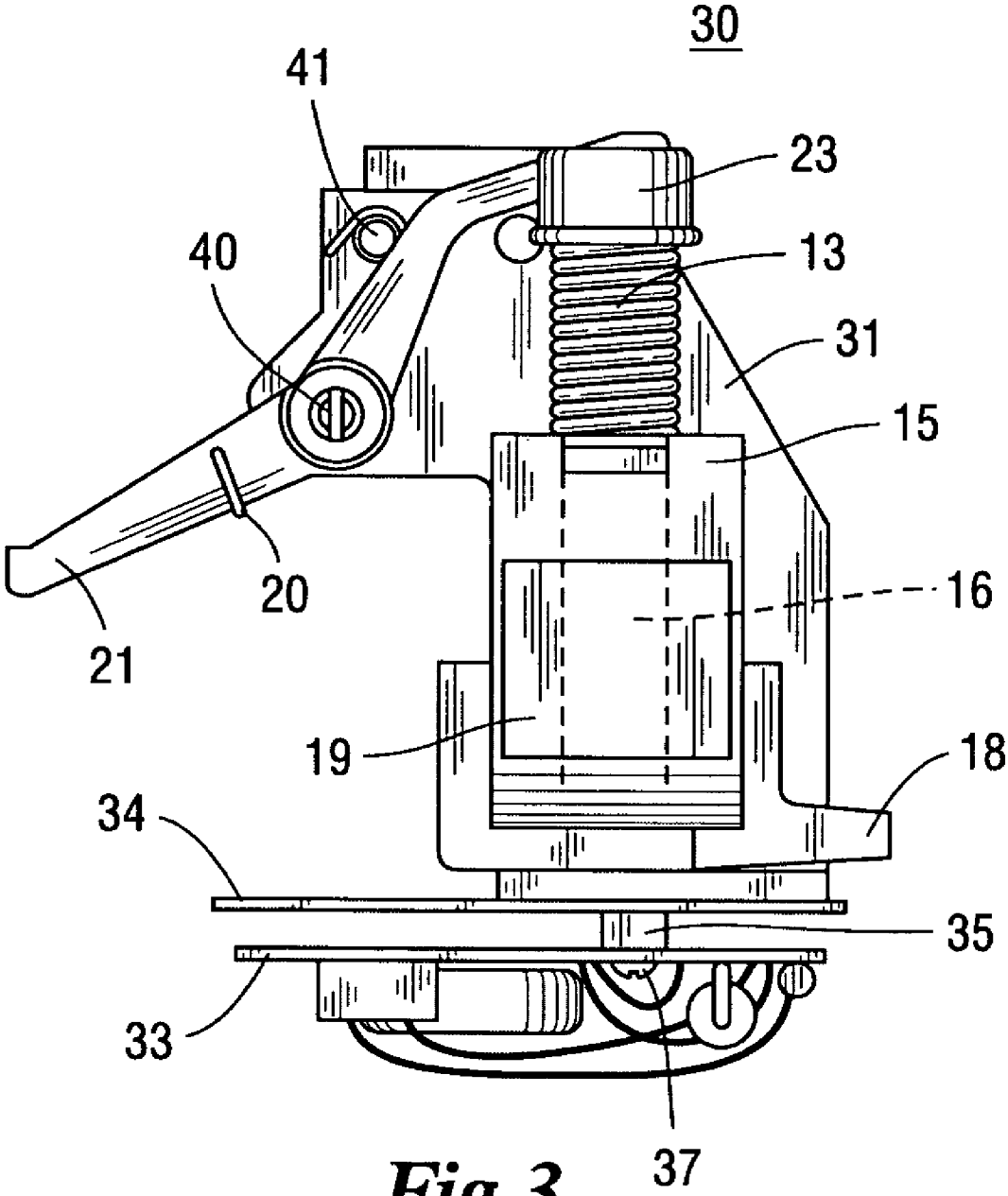
FIG. 3 is a top view of the under-voltage release mechanism of FIG. 2.

FIGS. 2-4 show an under-voltage release mechanism 30 including a mounting bracket 31, the trip device 10 of FIG. 1, and an angled support 32 (as best seen in FIG. 4). The mounting bracket 31 includes first 31*a*, second 31*b*, and third 31*c* portions. The second portion 31*b* is normal to the first portion 31*a*. The tripping device 10 and the angled support 32 are fixedly coupled to the mounting bracket 31. More specifically, the angled support 32 is fixedly coupled to the mounting bracket 31 between the first portion 31*a* (e.g., coupled to the bottom side of the first portion 31*a* with reference to FIG. 4) and second portion 31*b* (e.g., coupled to the left side of the second portion 31*b* with reference to FIG. 4) using a number of screws 36. The tripping device 10 is fixedly coupled to the mounting bracket 31 (e.g., coupled to the top of the first portion 31*a* with reference to FIG. 4) using some of the same screws 36 used to couple the angled support 32. The angled support 32 is structured to prevent flexing of the mounting bracket 31. A catch 45 is coupled to the first portion 31*a* of the mounting bracket 31 to facilitate coupling the under-voltage release mechanism 30 with a circuit breaker (not shown).

The under-voltage release mechanism 30 includes a circuit board 33 which is fixedly coupled to the third portion 31*c* of the mounting bracket 31. More specifically, a shield 34 is coupled to the left side (with reference to FIG. 4) of the third portion 31*c* of mounting bracket 31 using a suitable adhesive. The circuit board 33 is then coupled to the shield 34/third portion 31*c* of the mounting bracket 31 with a number of screws 37. A number of spacers 35 are employed to provide separation between the shield 34 and the circuit board 33. The under-voltage release mechanism 30 includes a number of leads 43 (FIG. 2) for electrically connecting the circuit board 33, for example, to a power source. The leads 43 are secured to the mounting bracket 31 using a wire tie 44.

The plunger reset lever 21 is rotateably coupled to the mounting bracket 31 on pivot 42. More specifically, the hub 21*a* of plunger reset lever 21 is coupled to pivot 42 using a lever cap 39, lock washer 38, and screw 40. The stop 41 is provided on the mounting bracket 31. When engaged by the plunger reset lever 21, the stop 41 prevents the plunger reset lever 21 from counterclockwise motion (with reference to FIG. 4). This, in turn, restricts the amount of travel of the plunger 11 relative to the cylindrical channel 16.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An under-voltage release mechanism comprising:

a mounting bracket including a first portion and a second portion normal to said first portion;

a tripping device fixedly coupled to said mounting bracket; and an angled support fixedly coupled to said mounting bracket between said first and second portion, said angled support structured to prevent flexing of said mounting bracket.

2. The under-voltage release mechanism of claim 1 wherein said tripping device includes:

a coil frame fixedly coupled to said mounting bracket;

a coil fixedly coupled to said coil frame, said coil having a channel extending therethrough;

a plunger reciprocatingly received within said channel;

a spring structured to bias said plunger within said channel; and at least one of (a) a number of anti-shook devices structured to eliminate movement of said coil relative to said coil frame or (b) a number of anti-shock devices structured to eliminate movement of said plunger relative to said channel.

3. The under-voltage release mechanism of claim 2 wherein said anti-shock devices structured to eliminate movement of said coil relative to said coil frame include at least one of a clip structured to eliminate side-to-side movement of said coil relative to said coil frame and a bumper structured to eliminate front-to-back movement of said coil relative to said coil frame.

4. The under-voltage release mechanism of claim 2 wherein said anti-shock devices structured to eliminate movement of said plunger relative to said channel include at least one of a bias spring structured to limit over-travel of a plunger reset lever during an energized state and a sleeve surrounding said plunger, said sleeve received within said channel.

5. The under-voltage release mechanism of claim 4, wherein said sleeve is pressed into said channel.

6. The under-voltage release mechanism of claim 2 wherein said plunger is structured to be engageable with a circuit breaker trip button.

7. The under-voltage release mechanism of claim 2 wherein said channel is cylindrical.

8. A tripping device comprising:

a coil frame;

a coil fixedly coupled to said coil frame, said coil having a cylindrical channel extending therethrough;

a plunger reciprocatingly received within said cylindrical channel;

a spring structured to bias said plunger within said cylindrical channel;

at least one of(a) a number of anti-shock devices structured to eliminate movement of said coil relative to said coil frame or (b) a number of and-shock devices structured to eliminate movement of said plunger relative to said cylindrical channel; and wherein said number of anti-shock devices structured to eliminate movement of said plunger relative to said cylindrical channel includes a bias spring structured to limit over-travel of a plunger reset lever during an energized state.

9. A tripping device comprising:

a coil frame;

a coil fixedly coupled to said coil frame, said coil having a cylindrical channel extending therethrough;

a plunger reciprocatingly received within said cylindrical channel;

a spring structured to bias said plunger within said cylindrical channel;

at least one of (a) a number of anti-shock devices structured to eliminate movement of said coil relative to said coil frame or (b) a number of anti-shock devices structured to eliminate movement of said plunger relative to said cylindrical channel; and wherein said number of anti-shock devices structured to eliminate movement of said plunger relative to said cylindrical channel includes at least one of a sleeve surrounding said plunger and received within said cylindrical channel and at least one of a bias spring structured to limit over-travel of a plunger reset lover during an energized state.

10. A tripping device comprising:

a coil frame;

a coil fixedly coupled to said coil frame, said coil having a cylindrical channel extending therethrough;

a plunger reciprocatingly received within said cylindrical channel;

a spring structured to bias said plunger within said cylindrical channel;

at least one of(a) a number of anti-shock devices structured to eliminate movement of said coil relative to said coil frame or (b) a number of anti-shock devices structured to eliminate movement of said plunger relative to said cylindrical channel;

wherein said coil frame is fixedly coupleable to a mounting bracket of an under-voltage release mechanism; and wherein said under-voltage release mechanism includes an angled support; wherein said mounting bracket has a first portion and a second portion, said second portion normal to first portion; and wherein said angled support is fixedly coupled to said mounting bracket between said first and second portions, said angled support being structured to prevent flexing of said mounting bracket.

* * * * *